US005591108A

United States Patent [19]

Chen

[11] Patent Number: 5,591,108

[45] **Date of Patent: *Jan. 7, 1997**

[54] ADJUSTABLE HORSE-RIDING TYPE EXERCISER

[76] Inventor: Paul Chen, 5th Floor, No. 31, Gan Tzou 2nd St., Shi Tun Chu, Taichung, Taiwan

[ * ] Notice: The term of this patent shall not extend beyond the expiration date of Pat. No. 5,478,298.

[21] Appl. No.: 605,866

[22] Filed: Feb. 23, 1996

Related U.S. Application Data

[63] Continuation-in-part of Ser. No. 442,346, May 16, 1995, Pat. No. 5,507,710.

[51] Int. Cl.[6] ..... A63B 69/06

[52] U.S. Cl. ..... 482/95; 482/72; 482/57; 482/96

[58] Field of Search ..... 482/95, 96, 72, 482/57, 111, 51, 148, 71; 472/110, 106; 280/1.182, 1.183, 1.192, 1.203, 1.204

[56] References Cited

U.S. PATENT DOCUMENTS

| | | | |
|---|---|---|---|
| 4,641,833 | 2/1987 | Tretheway | 482/72 |
| 5,478,298 | 12/1995 | Chen | 482/94 |
| 5,507,710 | 4/1996 | Chen | 482/72 |

*Primary Examiner*—Jerome Donnelly
*Attorney, Agent, or Firm*—Morton J. Rosenberg; David I. Klein

[57] ABSTRACT

A horse riding type exerciser includes a seat post pivotally coupled to a base. A handle is pivotally coupled to the base at a pivot shaft and has a panel secured to the handle and rotatable about the pivot shaft. A number of pivot axles are arranged on the panel and located above and below the pivot shaft. A link pivotally couples the seat post to either of the pivot axles. When the link is coupled to the pivot axle located above or below the pivot axle, the exerciser may be used for conducting either pull type or push type exercises.

1 Claim, 3 Drawing Sheets

ADJUSTABLE HORSE-RIDING TYPE EXERCISER

The application is a continuation-in-part of application Ser. No. 08/442,346, filed May 16, 1995, now U.S. Pat. No. 5,507,710 allowed on Dec. 26, 1995.

BACKGROUND OF THE INVENTION

1. Field of the Invention

The present invention relates to an exerciser, and more particularly to a horse-riding type exerciser convertible to both pull type and push type exercises.

2. Description of the Prior Art

Various kinds of horse riding type exercisers have been developed. Four prior arts are disclosed in U.S. Pat. No. 5,342,269 to Huang et al. issued Aug. 30, 1994; U.S. Pat. No. 5,356,357 to Wang et al. issued Oct. 18, 1994; U.S. Pat. No. 5,356,358 to Chen issued Oct. 18, 1994; and U.S. Pat. No. 5,366,428 to Liao issued Nov. 22, 1994.

However, the typical horse riding type exercisers are pull type exercisers, i.e., the handle bar may be pulled for conducting horse riding type exercises. The exercisers may not be used for conducting push type exercisers.

The present invention has arisen to mitigate and/or obviate the afore-described disadvantages of the conventional horse riding type exercisers.

SUMMARY OF THE INVENTION

The primary objective of the present invention is to provide a convertible horse-riding type exerciser which can be used for conducting both pull type and push type horse riding exercises.

In accordance with one aspect of the invention, there is provided a horse riding type exerciser comprising a base including a front portion having a pivot shaft provided therein, including a middle portion having a pivot pin provided therein, a seat post including a lower portion pivotally coupled to the base at the pivot pin, including an upper portion having a seat cushion provided thereon, and including a middle portion, a handle including a middle portion pivotally coupled to the base at the pivot shaft, including a hand grip device provided on top thereof and including a foot pedal device provided on a bottom thereof, the handle including at least one first pivot axle arranged above the pivot shaft and including at least one second pivot axle arranged below the pivot shaft, a link including a first end pivotally coupled to the middle portion of the seat post and including a second end pivotally coupled to at least of the first and second pivot axles, and a stop means for supporting the seat post and the seat cushion at a rest position and for allowing the seat post and the seat cushion to be rotated toward the handle. The seat cushion is elevated when the second end of the link is coupled to the second pivot axle and when the hand grip is pulled toward the seat cushion; and the seat cushion is elevated when the second end of the link is coupled to the first pivot axle and when the hand grip is pushed away from the seat cushion.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

A horse-riding type exerciser in accordance with the present invention may be used for conducting both pull type and push type horse riding exercises and for adjusting between the pull type and the push type horse riding exercises. A co-pending U.S. patent application was filed on Jun. 7, 1994 with the application Ser. No. 08/272,767, and issued on Jul. 4, 1995 with a U.S. Pat. No. 5,429,568. Another co-pending U.S. patent application was filed on Feb. 27, 1995 with the application Ser. No. 08/394,784, and issued on Dec. 26, 1995 with a U.S. Pat. No. 5,478,298. The co-pending U.S. patent applications are taken as a reference. The present invention is provided to different configuration for adjusting between the pull type and the push type horse riding exercises from the front portion of the exerciser.

Figure 1:
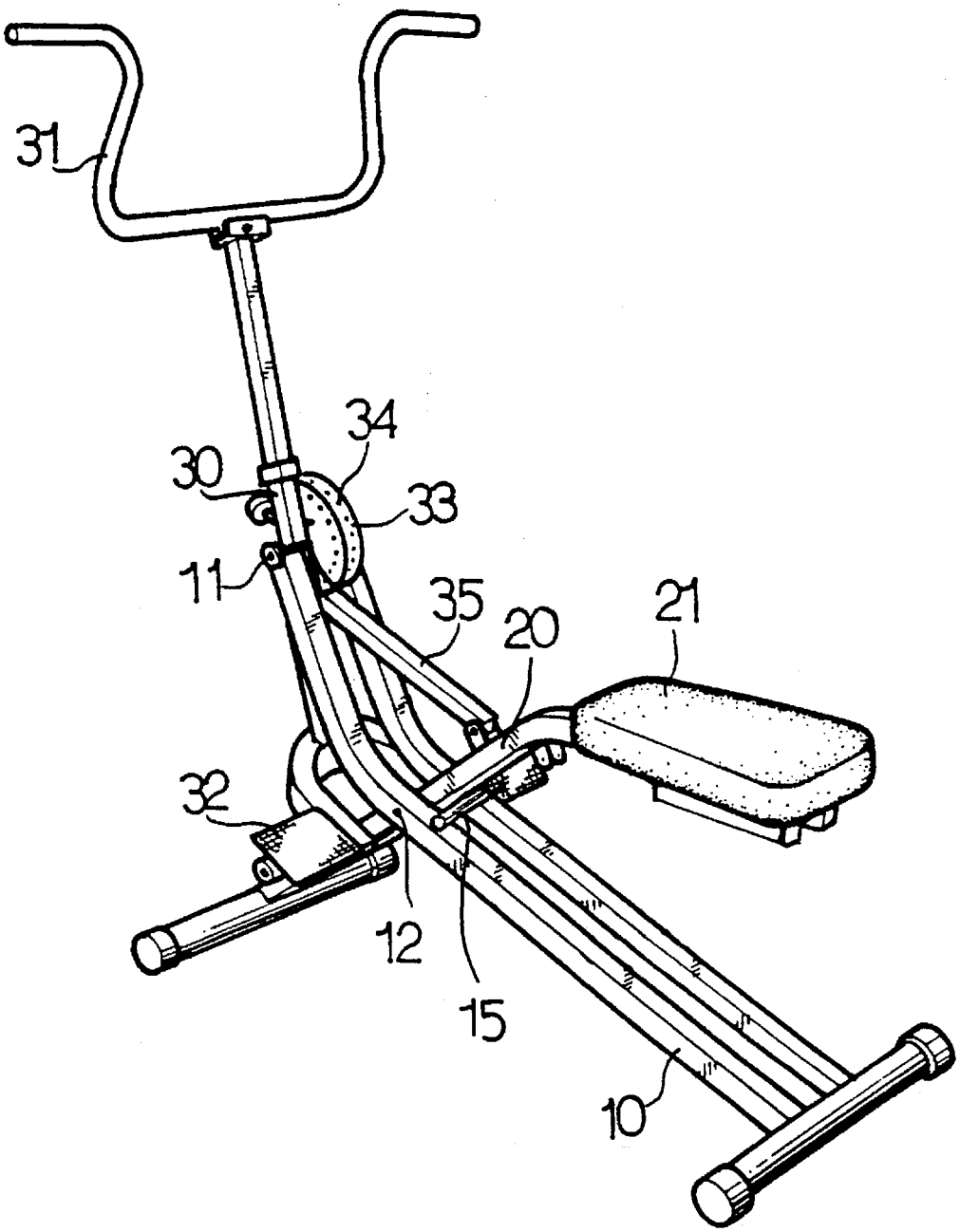
FIG. 1 is a perspective view of a horse-riding type exerciser in accordance with the present invention.
Figure 2:
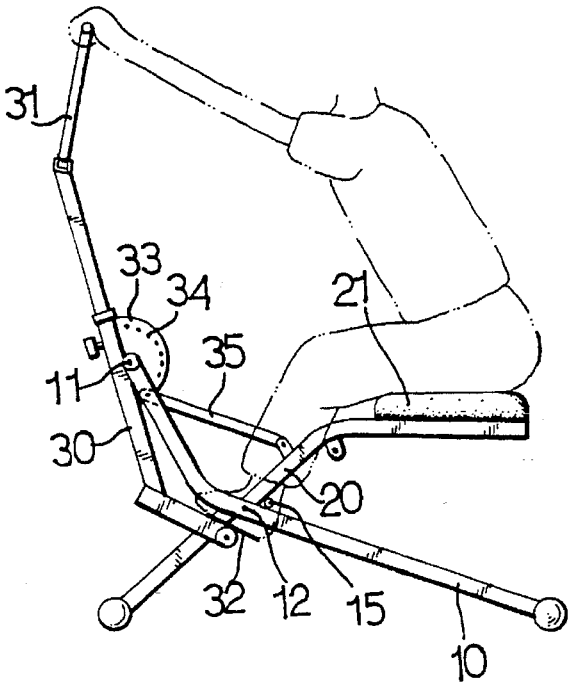
FIGS. 2, 3, 4 and 5 are plane views illustrating the operation of the adjustable horse-riding type exerciser.

Referring to the drawings, and initially to FIGS. 1 and 2, the exerciser in accordance with the present invention comprises a base 10 including a pivot shaft 11 provided in the front and upper portion thereof, including a pivot pin 12 provided in the middle portion. A seat post 20 includes a lower portion pivotally coupled to the base 10 at the pivot pin 12 and includes a seat cushion 21 provided on the upper portion thereof.

Figure 3:
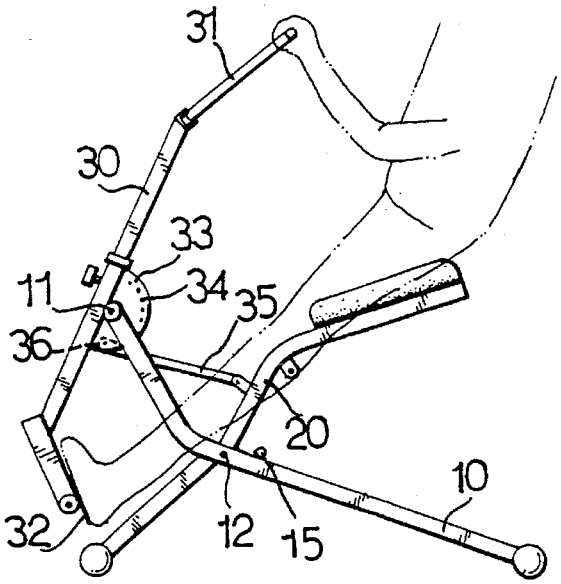
Figure 5:
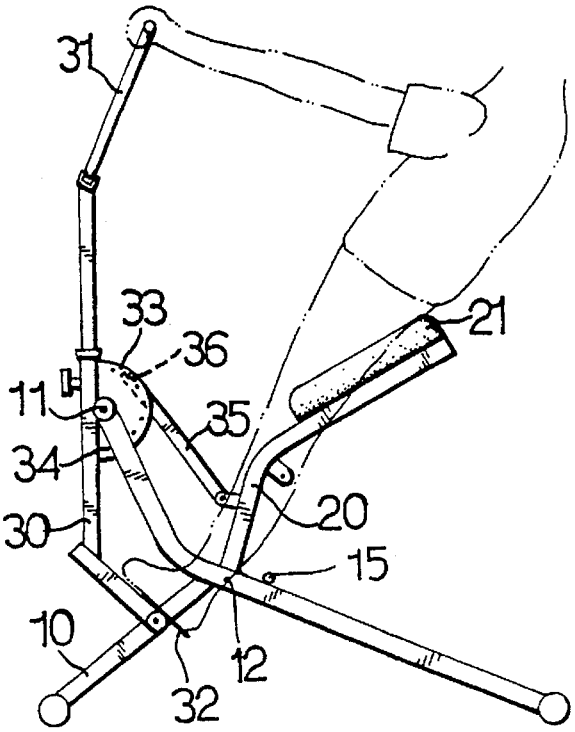

A handle 30 includes a hand grip device 31 provided on top thereof and includes a foot pedal device 32 provided on the bottom portion thereof. The handle 30 includes a middle portion pivotally coupled to the base 10 at the pivot shaft 11. A pair of panels 33 are substantially semi-circular in shape and are secured to the middle portion of the handle 30. The panels 33 include a center portion coincide with the pivot shaft 11 such that the panels 33 are also rotatable about the pivot shaft 11. The panels 33 each includes a peripheral portion having a number of holes 34 formed therein. A link 35 includes one end pivotally coupled to the middle portion of the seat post 20 and includes the other end pivotally coupled to either of the holes 34 by pivot axles 36 (FIG. 3).

Figure 4:
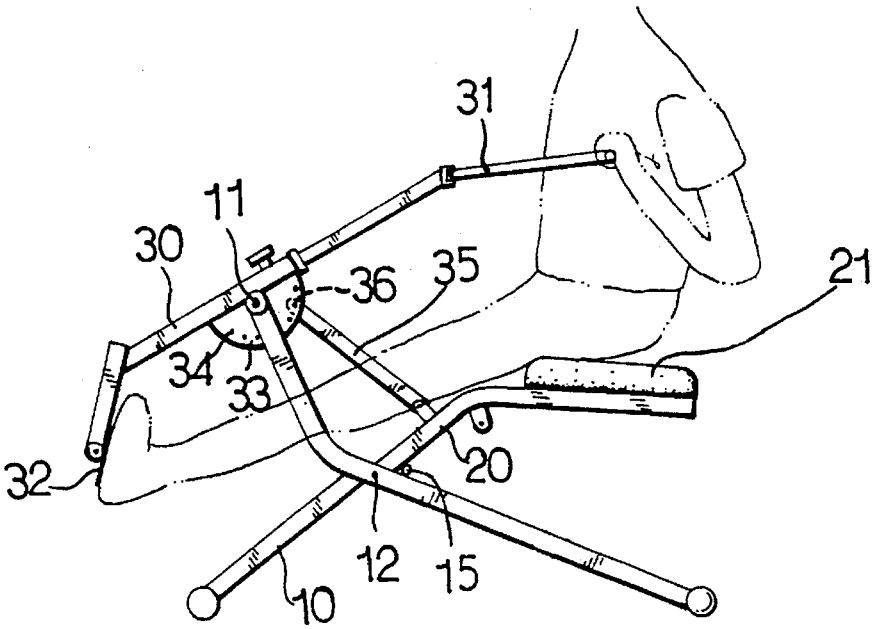

A stop rod 15 is secured on the base 10 for supporting the seat post 20 in a rest position (as shown in FIGS. 1, 2 and 4) and for preventing the seat cushion 21 from moving downward to engage with the base 10 and for allowing the seat post 20 and the seat cushion 21 to rotate toward the handle 30; i.e., for allowing the seat cushion 21 to be moved upward.

It is to be noted that the holes 34 or the pivot axles 36 includes one or more thereof located above the pivot shaft 11 and includes the other located below the pivot shaft 11. As shown in FIGS. 2 and 3, when the link 35 is coupled to the holes 34 located below the pivot shaft 11, the seat cushion 21 may be elevated when the hand grip 31 is pulled by the users such that the users may conduct pull type horse riding type exercises. However, when the link 35 is coupled to the holes located above the pivot shaft 11, the seat cushion 21 may be elevated when the hand grip 31 is pushed forward by the users such that the users may conduct push type horse riding type exercises.

It is further to be noted that the holes 34 are formed in the peripheral portion of the panels 33. When the link 35 is coupled to different holes 34, the relative position between the handle 30 and the seat post 20 may be adjusted according to the different sizes of the users.

Accordingly, the horse-riding type exerciser in accordance with the present invention can be used for conducting both pull type and push type horse riding exercises. In addition, the link may be coupled to different holes formed in the peripheral portion of the panels so as to adjust the relative position between the handle and the seat post.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A horse riding type exerciser comprising:

a base including a front portion having a pivot shaft provided therein, including a middle portion having a pivot pin provided therein, a seat post including a lower portion pivotally coupled to said base at said pivot pin, including an upper portion having a seat cushion provided thereon, and including a middle portion, a handle including a middle portion pivotally coupled to said base at said pivot shaft, including a hand grip device provided on top thereof and including a foot pedal device provided on a bottom thereof, said handle including at least one first pivot axle arranged above said pivot shaft and including at least one second pivot axle arranged below said pivot shaft, a link including a first end pivotally coupled to said middle portion of said seat post and including a second end pivotally coupled to at least of said first and second pivot axles, and a stop means for supporting said seat post and said seat cushion at a rest position and for allowing said seat post and said seat cushion to be rotated toward said handle, wherein, said seat cushion is elevated when said second end of said link is coupled to said second pivot axle and when said hand grip is pulled toward said seat cushion; and said seat cushion is elevated when said second end of said link is coupled to said first pivot axle and when said hand grip is pushed away from said seat cushion.

* * * * *